US006643895B1

(12) United States Patent
Domenig et al.

(10) Patent No.: US 6,643,895 B1
(45) Date of Patent: Nov. 11, 2003

(54) FULL OVERLAY HINGE

(75) Inventors: Georg Domenig, Kernersville, NC (US); Manfred Peer, Walkertown, NC (US); Todd Booker, Garner, NC (US)

(73) Assignee: Grass America Inc., Kernersville, NC (US)

( * ) Notice: Subject to any disclaimer, the term of this patent is extended or adjusted under 35 U.S.C. 154(b) by 0 days.

(21) Appl. No.: 10/186,444

(22) Filed: Jul. 1, 2002

(51) Int. Cl.[7] ..... E05D 7/04
(52) U.S. Cl. ..... 16/238; 16/242; 16/246
(58) Field of Search ..... 16/238, 242, 246, 16/235, 236, 237, 265, 382

(56) References Cited

U.S. PATENT DOCUMENTS

| | | | | | |
|---|---|---|---|---|---|
| 4,091,499 | A | * | 5/1978 | Lautenschlager | 16/242 |
| 4,506,409 | A | | 3/1985 | Lautenschlager | |
| 4,620,343 | A | * | 11/1986 | Grass | 16/236 |
| 4,716,622 | A | | 1/1988 | DeBruyn | |
| 5,036,565 | A | | 8/1991 | Salice | |
| 5,392,493 | A | | 2/1995 | Youngdale | |
| 5,511,287 | A | | 4/1996 | Lautenschlager et al. | |
| 5,604,956 | A | | 2/1997 | Grass | |
| 5,737,804 | A | | 4/1998 | Ferrari et al. | |
| 5,826,305 | A | | 10/1998 | Domenig et al. | |
| 5,887,316 | A | | 3/1999 | Ferrari et al. | |
| 5,920,958 | A | | 7/1999 | Domenig et al. | |
| 5,930,866 | A | | 8/1999 | Rupprechter | |
| 6,049,946 | A | | 4/2000 | Cress et al. | |
| 6,125,508 | A | | 10/2000 | Formenti | |
| 6,145,164 | A | * | 11/2000 | Ferrari et al. | 16/242 |
| 6,167,590 | B1 | | 1/2001 | Domenig | |
| 6,170,121 | B1 | | 1/2001 | Domenig | |
| 6,240,599 | B1 | | 6/2001 | Peer et al. | |
| 6,289,556 | B1 | * | 9/2001 | Salice | 16/335 |
| 6,442,798 | B1 | * | 9/2002 | Rupprechter | 16/242 |
| 6,463,626 | B1 | * | 10/2002 | Ferrari et al. | 16/236 |
| 6,470,531 | B2 | | 10/2002 | Domenig et al. | |
| 6,523,225 | B1 | * | 2/2003 | Pecar | 16/382 |

FOREIGN PATENT DOCUMENTS

| | | | |
|---|---|---|---|
| JP | 2000-104446 | * | 4/2000 |
| WO | WO 01/84261 A1 | * | 11/2001 |

* cited by examiner

*Primary Examiner*—Chuck Y. Mah
(74) *Attorney, Agent, or Firm*—John M. Harrington; Kilpatrick Stockton LLP

(57) ABSTRACT

This invention relates to hinges for mounting a door on a furniture article frame. The hinges include at least a hinge cup member adapted to be affixed to the furniture door, a top hinge arm segment pivotably connected to the hinge cup member and comprising a top elongated aperture and two tabs, and an L-shaped hinge arm segment comprising at least a circular aperture, a center hole and two grooves. A base hinge arm segment comprising an elongated center hole, a circular aperture and an upper flange may also be used with the top hinge arm segment and the L-shaped hinge arm segment to allow adjustments to be made in a third direction. In some embodiments, turning a cam or eccentric screw allows adjustments to be made horizontally from side-to-side so that the desired spacing of the door from opposite sides of the door opening can be set. In some embodiments, turning a cam or eccentric screw allows adjustments to be made horizontally in-and-out so that the desired alignment of the door with the front face of the furniture article frame can be set. Finally, in some embodiments, vertical adjustments can also be made by loosening a fastening screw so that the desired spacing from the top and bottom of the door opening can be set.

30 Claims, 13 Drawing Sheets

FULL OVERLAY HINGE

FIELD OF THE INVENTION

The present invention relates generally to hinge devices for mounting a door on a furniture article, and more particularly to adjustable hinge devices for hanging doors on cabinets or the like so that the doors can be adjusted relative to the supporting frame they are attached to.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282, 5,392,493, and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

SUMMARY OF THE INVENTION

Accordingly, the above-identified shortcomings of existing adjustable hinges are overcome by embodiments of the present invention. The general purpose of the present invention, which will be described subsequently in greater detail, is to provide new and improved adjustable hinges for mounting a door on a frame of a furniture article such as a cabinet or desk, that is easily adjustable for adjusting the door relative to the supporting frame, and that has all of the advantages of prior art hinges and none of the disadvantages. The present invention provides a hinge that is microadjustable, or continuously adjustable in a precise manner, throughout the range of adjustment provided. Further, the present invention provides a hinge that enables stable microadjustments by actuating a single adjustment screw for each directional adjustment. The components of the hinge remain stably secured to each other, and to the door and the frame of the furniture article throughout the adjustment. Adjustment may be accomplished by a single person without the door becoming unsecured or unstable relative to the frame of the furniture article.

Some representative embodiments of the present invention are illustrated in the drawings. Some embodiments of the hinges of the present invention make use of a first hinge member in the form of a cup mountable flush in a bore hole with fastening screws in a known way in the back of a door, and a second hinge member adapted to be affixed to a frame. The second hinge member is in the form of a hinge arm that includes a substantially flat base portion/segment preferably comprising an opening in the form of an elongated slot through which a fastening screw can be driven into the frame in a known way, thereby attaching the hinge to the frame and allowing adjustments to be made in an up-and-down or vertical direction. The second hinge member of the present invention may also include adjustment mechanisms on the hinge arm for allowing adjustments to be made in a second and/or third direction. One adjustment mechanism may allow adjustments to be made in an in-and-out, forward-and-back, or horizontal direction. Another adjustment mechanism may allow adjustments to be made in another horizontal direction so that side-to-side adjustments of the door can be made.

Other embodiments of the hinges of the present invention may have fewer pieces and therefore may be more economical to manufacture. These embodiments may make use of a first hinge member in the form of a cup mountable flush in a bore hole with fastening screws in a known way in the back of a door, and a second hinge member adapted to be affixed to a frame. This second hinge member may be in the form of a hinge arm that includes an L-shaped portion/segment preferably comprising an opening in the form of an elongated slot through which a fastening screw can be driven into the frame in a known way, thereby attaching the hinge to the furniture frame and allowing adjustments to be made in an up-and-down or vertical direction. The second hinge member of the present invention may also include adjustment mechanisms on the hinge arm for allowing adjustments to be made in a second and/or third direction. One such adjustment mechanism may allow adjustments to be made in a horizontal direction so that side-to-side adjustments of the door can be made.

In a preferred embodiment, the present invention relates to a three-dimensionally adjustable hinge for mounting a door on a frame of a furniture article. This hinge comprises a four piece hinge arm construction and comprises a hinge cup member adapted to be affixed to a furniture door; a top hinge arm segment pivotably connected at its arm end to the hinge cup member and comprising an elongated aperture and two tabs; a base hinge arm segment comprising an elongated center hole, a circular aperture and an upper flange; and an L-shaped hinge arm segment comprising a center hole, a circular aperture, an elongated aperture, a retaining wall, two grooves and two flaps, wherein the top hinge arm segment is slideably connected to the L-shaped hinge arm segment with a first cam screw or an eccentric screw via the elongated aperture in the top hinge arm segment and the circular aperture in the L-shaped hinge arm segment, the base hinge arm segment is adjustably connected to the L-shaped hinge arm segment via an upper flange on the base hinge arm segment and a retaining wall on the L-shaped hinge arm segment, and the base hinge arm segment is slideably connected to the L-shaped hinge arm segment by a second cam or eccentric screw cooperating with the elongated aperture in the L-shaped hinge arm segment and the circular aperture in the base hinge arm segment. Turning this first cam or eccentric screw causes the L-shaped hinge arm segment, and therefore the top hinge arm segment since they are connected together, to move relative to the base hinge arm segment in a horizontally side-to-side direction, thereby allowing adjustments to be made to the spacing of the door from the opposite sides of the cabinet door opening. Turning this second cam or eccentric screw causes the L-shaped hinge arm segment to move relative to the base hinge arm segment in a horizontal in-and-out direction, thereby allowing adjustments to be made to the alignment of the front face of the door with respect to the front of the frame. The elongated center hole in the base hinge arm segment allows vertical up-and-down adjustments to be made to the door, thereby allowing adjustments to be made to the spacing of the door from the top and bottom of the cabinet door opening.

In another embodiment, the present invention relates to a two-dimensionally adjustable hinge for mounting a door on a frame of a furniture article. This hinge comprises a three piece hinge arm construction and comprises a hinge cup member adapted to be affixed to a furniture door; a top hinge arm segment pivotably connected at its arm end to the hinge cup member and comprising an elongated aperture and two tabs; and an L-shaped hinge arm segment comprising an elongated center hole, a circular aperture, two grooves and two flaps, wherein the top hinge arm segment is slideably connected to the L-shaped hinge arm segment with a cam screw or an eccentric screw via the elongated aperture in the top hinge arm segment and the circular aperture in the L-shaped hinge arm segment. Turning this cam screw causes the L-shaped hinge arm segment to move relative to the top hinge arm segment in a horizontally side-to-side direction, thereby allowing adjustments to be made to the spacing of the door from the opposite sides of the cabinet door opening. The elongated center hole in the L-shaped hinge arm segment allows vertical up-and-down adjustments to be made to the door, thereby allowing adjustments to be made to the spacing of the door from the top and bottom of the cabinet door opening. Since there is no base hinge arm segment and no second cam screw in this hinge, this hinge is less expensive to manufacture than the three-dimensionally adjustable hinge. However, there is no way to adjust this hinge horizontally in-and-out, so the alignment of the front face of the door with respect to the front of the frame cannot be adjusted.

In yet another embodiment, the present invention relates to another three-dimensionally adjustable hinge for mounting a door on a frame of a furniture article. This hinge comprises a four piece hinge arm construction and comprises a hinge cup member adapted to be affixed to a furniture door; a top hinge arm segment pivotably connected at its arm end to the hinge cup member and comprising an elongated aperture and two slots; a base hinge arm segment comprising an elongated center hole, a circular aperture, an upper flange and two opposing side members; an intermediate hinge arm segment comprising a circular aperture and two retaining ledges; and an L-shaped hinge arm segment comprising a center hole, a circular aperture, an elongated aperture, a retaining wall, two grooves, two retaining ramps and two opposing side members, wherein the intermediate hinge arm segment is fixedly-attached to the two retaining ramps of the L-shaped hinge arm segment via the two retaining ledges on the intermediate hinge arm segment, the L-shaped hinge arm segment and the intermediate hinge arm segments are adjustably connected to the top hinge arm segment with a first cam screw or an eccentric screw via the elongated aperture in the top hinge arm segment and the circular aperture in the L-shaped hinge arm segment and the circular aperture in the intermediate hinge arm segment, the base hinge arm segment is adjustably connected to the L-shaped hinge arm segment via an upper flange on the base hinge arm segment and a retaining wall on the L-shaped hinge arm segment, the base hinge arm segment is slideably connected to the L-shaped hinge arm segment by a second cam or eccentric screw cooperating with the elongated aperture in the L-shaped hinge arm segment and the circular aperture in the base hinge arm segment. Turning this first cam or eccentric screw causes the top hinge arm segment to move relative to the L-shaped hinge arm segment in a horizontally side-to-side direction, thereby allowing adjustments to be made to the spacing of the door from the opposite sides of the cabinet door opening. Turning the second cam or eccentric screw causes the L-shaped hinge arm segment to move relative to the base hinge arm segment in a horizontal in-and-out direction, thereby allowing adjustments to be made to the alignment of the front face of the door with respect to the front of the frame. The elongated center hole in the base hinge arm segment allows vertical up-and-down adjustments to be made to the door, thereby allowing adjustments to be made to the spacing of the door from the top and bottom of the cabinet door opening.

In another preferred embodiment, at least one of the hinge arm segments further comprises opposing lateral edges from which depend a pair of opposing side members that define a channel for receiving another hinge arm segment. More preferably, the opposing lateral edges are spaced from one another a distance that defines a width of the hinge arm segment. Most preferably, the opposing side members are spaced from one another a distance that is at least as great as the width of another hinge arm segment. For example, in the first three-dimensionally adjustable hinge discussed above, the L-shaped hinge arm segment and the base hinge arm segment may both have opposing side members that define the width of the respective segments, with the width of the base hinge arm segment being slightly less than the width of the top hinge arm segment so that the opposing side members of the base hinge arm segment nest within the opposing side members of the top hinge arm segment.

In the second three-dimensionally adjustable hinge discussed above, the L-shaped hinge arm segment and the base hinge arm segment may both have opposing side members that define the width of the respective segments, with the width of the base hinge arm segment being slightly less than the width of the L-shaped hinge arm segment so that the opposing side members of the base hinge arm segment nest within the opposing side members of the L-shaped hinge arm segment. Alternatively, the base, the L-shaped and the top hinge arm segments of this hinge could all have opposing side members defining the width of each respective segment, with the widths of the segments varying so that the opposing side members of all three hinge arm segments nest together one within another.

The three-dimensional adjustment aspect of some embodiments of the adjustable hinge of the present invention not only allows adjustment of the position of a cabinet door vertically up-and-down relative to the supporting cabinet (i.e., up and down with the door in the closed position to achieve desired spacing of the door from the top and bottom of the cabinet door opening) and horizontally in-and-out relative to the supporting cabinet (i.e., to and fro with the door in the closed position to achieve desired alignment of the front face of the door with the front of the cabinet), but also enables adjustment of the cabinet door horizontally from side-to-side relative to the supporting cabinet (i.e., from side to side with the door in the closed position to achieve desired spacing of the door from the opposite sides of the cabinet door opening).

Embodiments of the adjustable hinges of the present invention may also include, for example, a base hinge arm segment comprising an elongated center hole that extends parallel to the pivot axis of the hinge. If the hinge includes a base hinge arm segment, the L-shaped hinge arm segment preferably comprises a center hole that is somewhat rectangular and larger than the center hole of the base plate. In embodiments, the base hinge arm segment is adapted to be fastened on the furniture article frame by at least one mounting screw inserted, preferably, through the elongated center hole of the base hinge arm segment, and the elongated center hole in the base hinge arm segment allows the base hinge arm segment to be displaced relative to the furniture article frame in a vertical direction (when the hinge is in its mounted and closed position) parallel to the pivot axis of the hinge by loosening the single mounting screw. In other embodiments, the L-shaped hinge arm segment comprises an elongated center hole that extends parallel to the pivot axis of the hinge, and the L-shaped hinge arm segment is adapted to be fastened on the furniture article frame by at least one mounting screw inserted, preferably, through the elongated center hole of the L-shaped hinge arm segment, and the elongated center hole in the L-shaped hinge arm segment allows the L-shaped hinge arm segment to be displaced relative to the furniture article frame in a vertical direction (when the hinge is in its mounted and closed position) parallel to the pivot axis of the hinge by loosening the single mounting screw.

The cam or eccentric screw is generally mounted in a hinge arm segment by means of a projection, and then extends through an elongated opening in another hinge arm segment to hold the two hinge arm segments together. The cam or eccentric screw is rotatable about a central axis thereof, and the projection extends parallel to the central axis of the cam or eccentric screw and is radially offset therefrom.

In the first three-dimensionally adjustable hinge discussed above, the first cam or eccentric screw is mounted in the L-shaped hinge arm segment by means of a projection, and the cam or eccentric screw then extends through the elongated slot in the top hinge arm segment. The elongated slot in the top hinge arm segment extends parallel to the pivot axis of the hinge. Turning this first cam or eccentric screw causes the top hinge arm segment to be displaced on the L-shaped hinge arm segment in a direction perpendicular to the pivot axis of the hinge. There is also a second cam screw in this hinge, mounted in the base hinge arm segment by means of a projection, and the cam screw then extends through the elongated slot in the L-shaped hinge arm segment. The elongated slot in the L-shaped hinge arm segment extends parallel to the pivot axis of the hinge. Turning this second cam or eccentric screw causes the base hinge arm segment to be displaced on the L-shaped hinge arm segment in another direction perpendicular to the pivot axis of the hinge. The first and second cam screws in this hinge allow adjustments to be made to the hinge in two different horizontal directions, each at ninety degrees (90°) to the other.

In the two-dimensionally adjustable hinge discussed above, the first cam or eccentric screw is mounted in the L-shaped hinge arm segment by means of a projection, and the cam or eccentric screw then extends through the elongated slot in the top hinge arm segment. The elongated slot in the top hinge arm segment extends parallel to the pivot axis of the hinge. Turning this first cam or eccentric screw causes the L-shaped hinge arm segment to be displaced on the top hinge arm segment in a direction perpendicular to the pivot axis of the hinge. There is no second cam or eccentric screw, nor is there a base hinge arm segment in this embodiment of the present invention. Thus, this embodiment of the present invention comprises less parts and is thereby, cheaper to produce.

In the second three-dimensionally adjustable hinge discussed above, the first cam or eccentric screw is mounted in the L-shaped hinge arm segment by means of a projection, and the first cam or eccentric screw then extends through the elongated center hole in the top hinge arm segment. The first cam or eccentric screw extends in the other direction through the benter hole in the intermediate hinge arm segment. The elongated center hole in the L-shaped hinge arm segment extends perpendicular to the pivot axis of the hinge. The second cam or eccentric screw in this hinge embodiment is mounted in the base hinge arm segment by means of a projection, and the cam or eccentric screw then extends through the elongated hole in the L-shaped intermediate hinge arm segment. The elongated center hole in this L-shaped intermediate hinge arm segment extends parallel to the pivot axis of the hinge, as do the elongated apertures in this base hinge arm segment. Turning this first cam or eccentric screw causes the L-shaped hinge arm segment to be displaced on the top hinge arm segment in a direction perpendicular to the pivot axis of the hinge. Turning this second cam or eccentric screw causes the L-shaped hinge arm segment to be displaced on the base hinge arm segment in a direction perpendicular to the pivot axis of the hinge.

The foregoing discussion focuses on the more important features of the invention so that the detailed description that follows may be better understood, and so that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on a frame of a furniture article such as a desk or cabinet which comprises all of the advantages, and more, of prior art devices and none of the disadvantages.

It is another object of the present invention to provide a new and improved hinge for mounting a door on a frame of a furniture article that is more reliable and functional than those presently available.

Yet another object of the present invention is to provide a new and sophisticated, precision-made adjustable hinge that is compact, that can operate reliably and efficiently, and yet enable renewed, limited adjustments to be made to the mounted door with respect to the frame of the furniture article.

It is an additional feature and advantage of the present invention to provide an adjustable hinge with a three-way adjustment aspect, which enables adjustment of the cabinet door horizontally in-and-out relative to the supporting cabinet (i.e., to and fro with the door in the closed position to achieve desired alignment of the front face of the door with the front of the cabinet), up-and-down (i.e., up and down with the door in the closed position to achieve desired spacing of the door from the top and bottom of the cabinet door opening), and side-to-side (i.e., from side to side with the door in the closed position to achieve desired spacing of the door from the opposite sides of the cabinet door opening).

These, together with other objects of the present invention, along with the various features of novelty which characterize the invention, are pointed out with particularity in the claims annexed to and forming a part of this document.

Embodiments of hinges according to the present invention include one or more unique aspects. Some embodiments of the present invention include many, if not all, of the above-mentioned aspects, but other embodiments may include less than all of the above-mentioned aspects.

Further objects, aspects and advantages of the present invention will be more readily apparent to those skilled in the art during the course of the following description, wherein references are made to the accompanying drawings which illustrate some preferred forms of the present invention and wherein like characters of reference designate like parts throughout the drawings.

DETAILED DESCRIPTION

For the purposes of promoting an understanding of the invention, reference will now be made to some preferred embodiments of the present invention as illustrated in FIGS. 1–13, and specific language used to describe the same. Numerous specific details are set forth below in order to provide a thorough understanding of the present invention. However, it will be obvious to one skilled in the art, that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

Figure 1:
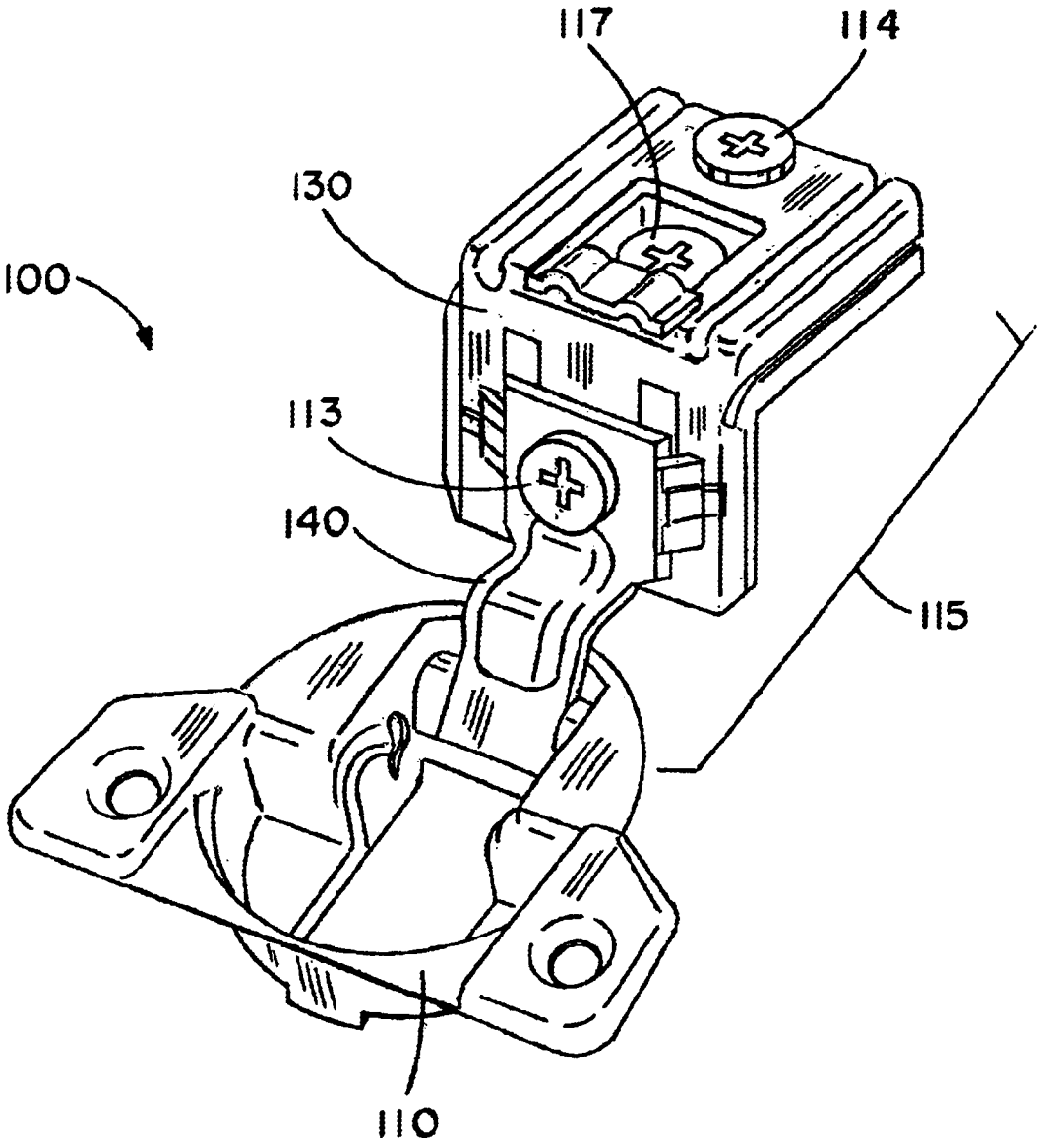
FIG. 1 is a top perspective view of one embodiment of a three-dimensionally adjustable hinge of the present invention comprising a three-piece hinge arm construction.
Figure 2:
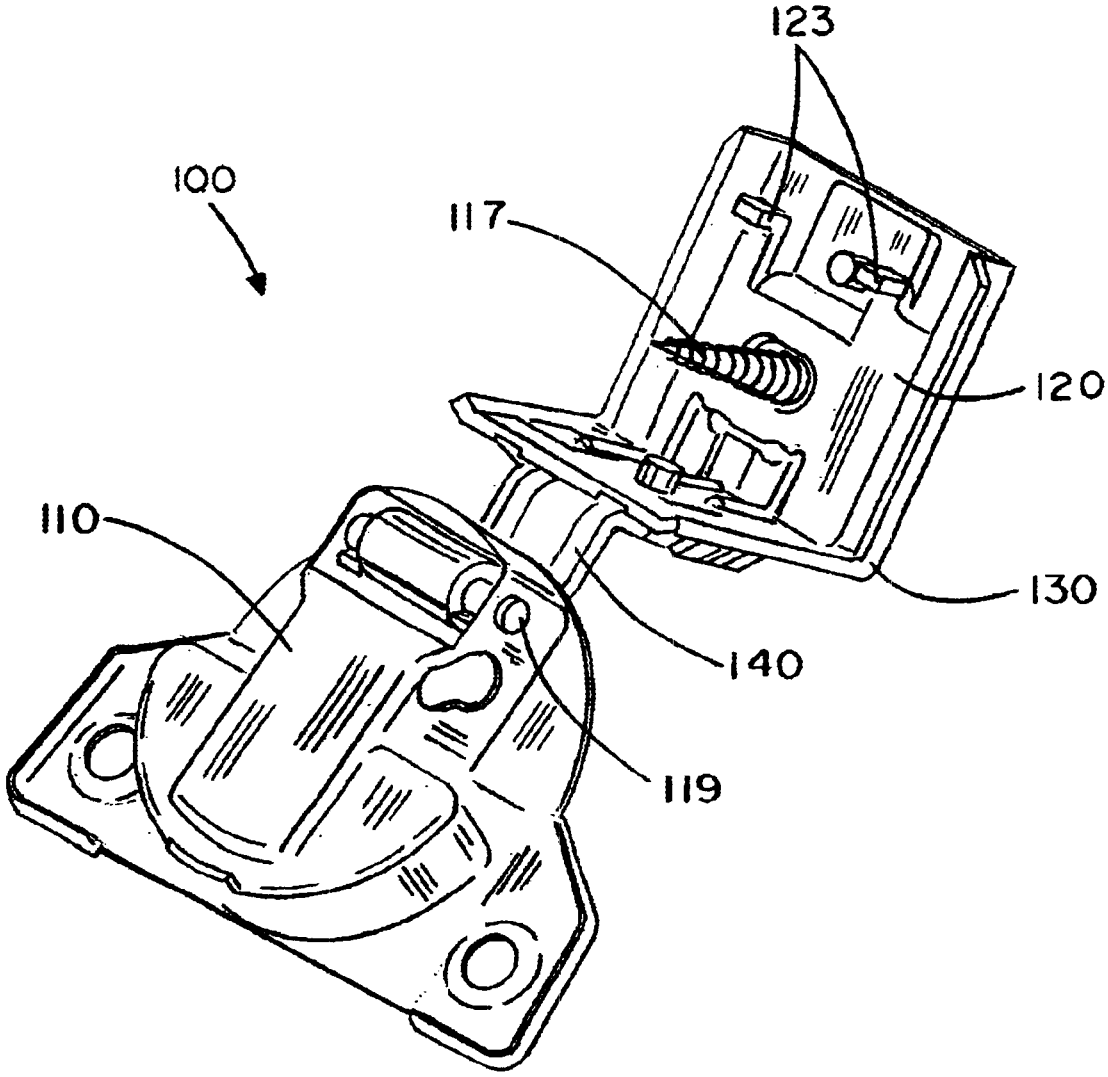
FIG. 2 is a bottom perspective view of the adjustable hinge shown in FIG. 1.
Figure 3:
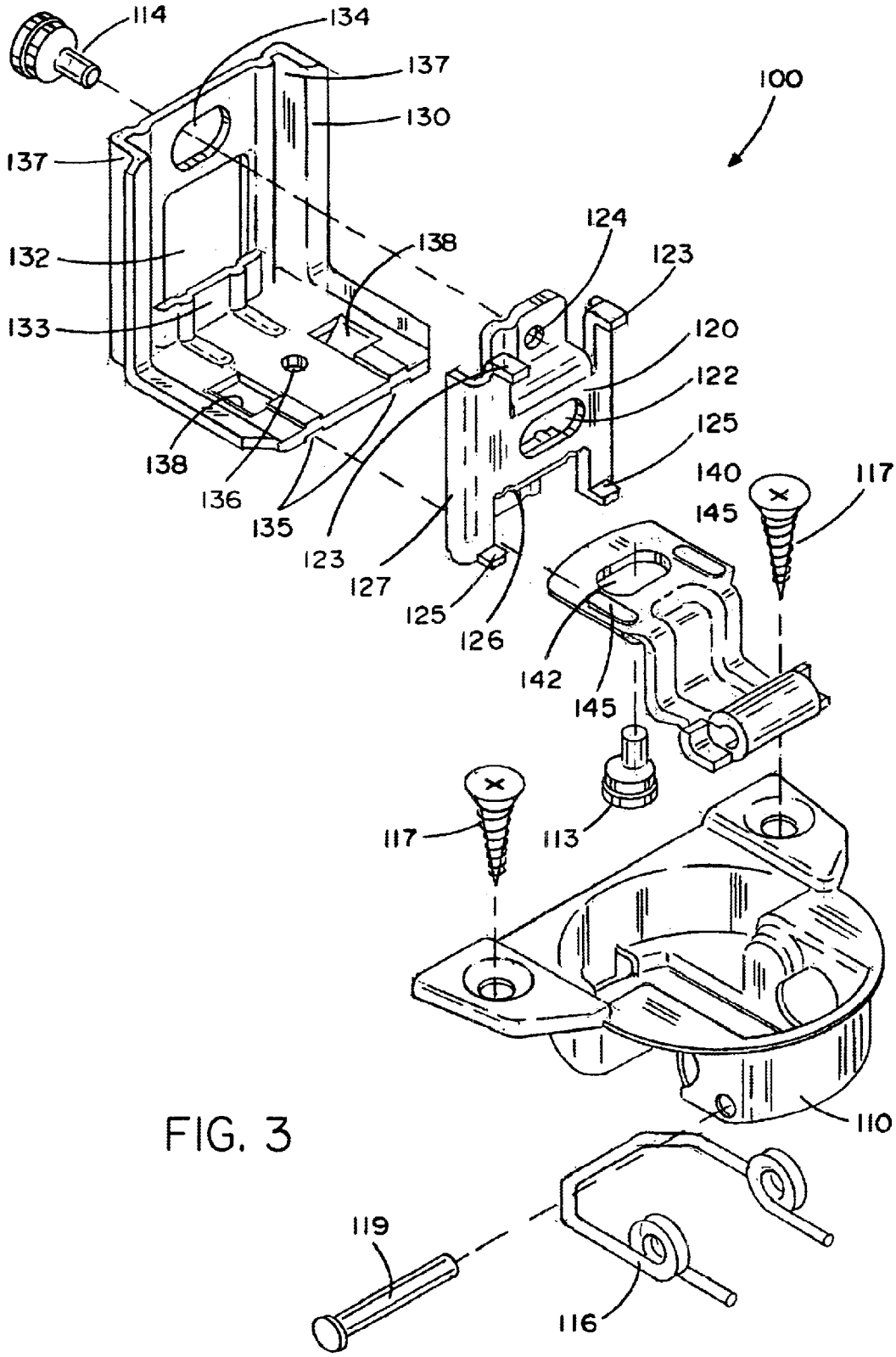
FIG. 3 is an exploded view of the adjustable hinge shown in FIGS. 1 and 2.
Figure 4:
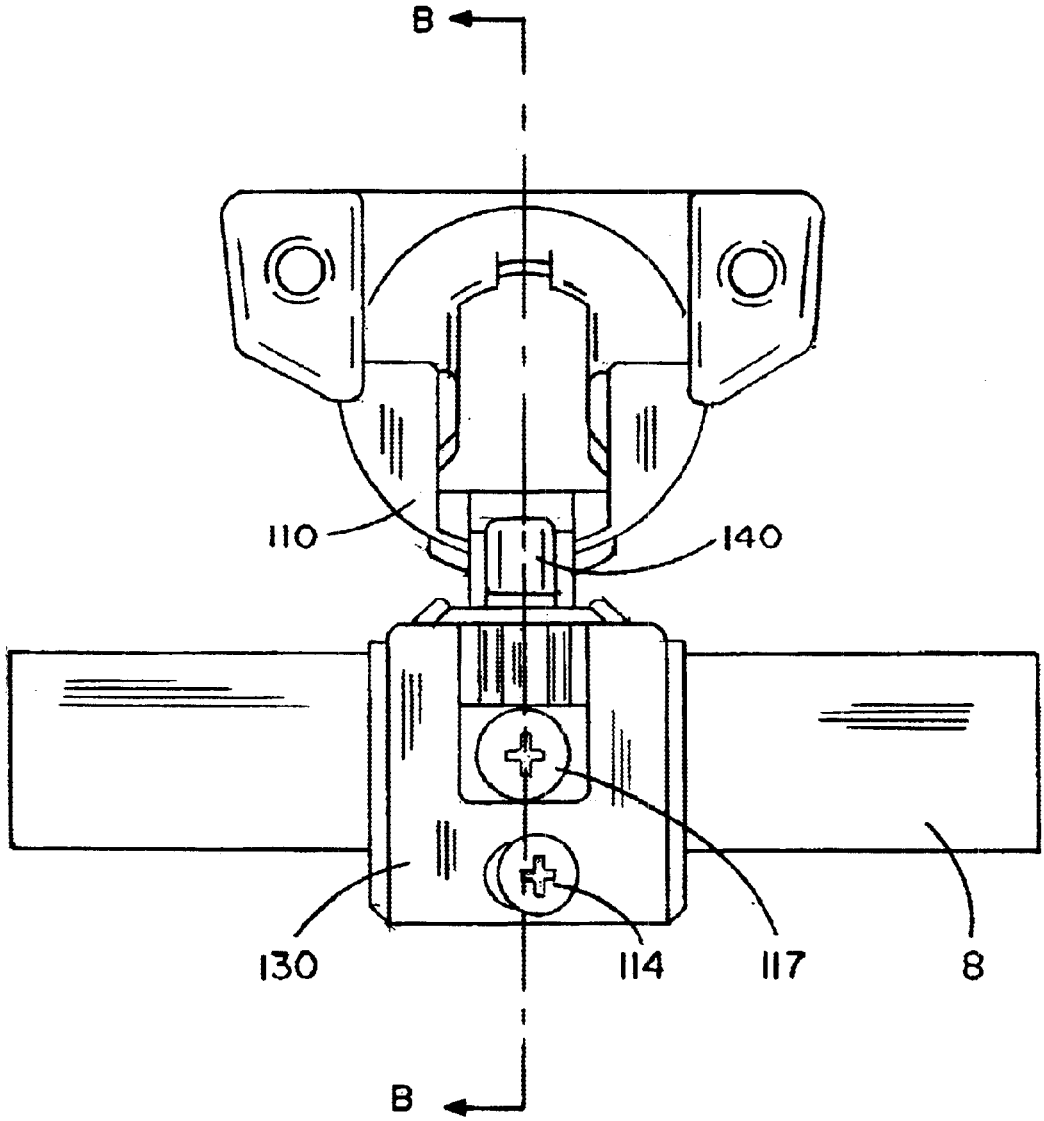
FIG. 4 is a top view of the adjustable hinge shown in FIGS. 1–3, showing the hinge in an open position.
Figure 5:
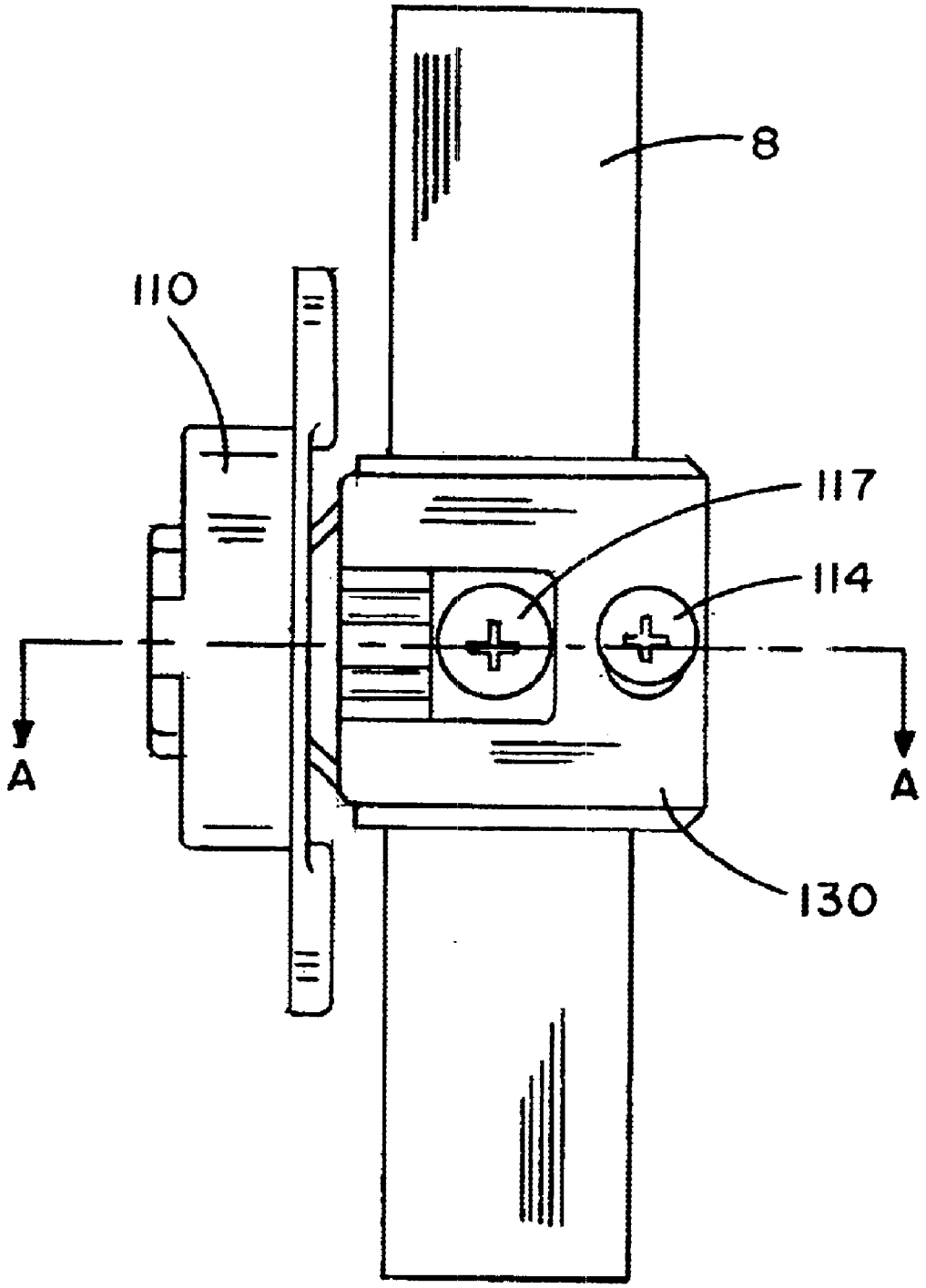
FIG. 5 is a top view of the adjustable hinge shown in FIGS. 1–4, showing the hinge in a closed position.

Referring now to FIGS. 1–5, there is shown various views of one embodiment of a three-dimensionally adjustable hinge 100 of the present invention comprising a three-piece hinge arm construction. These hinges may be used to hang a door on a frame 8 of a furniture article, such as a cabinet. FIG. 1 shows a top perspective view of hinge 100 in an open position (as it would appear when the cabinet door is open) and FIG. 2 shows a bottom perspective view of hinge 100 in an open position. FIG. 3 shows an exploded view of hinge 100 so that all the individual parts of hinge 100 can be more readily seen and understood. FIG. 4 shows a top view of hinge 100 in an open position attached to frame 8 and FIG. 5 shows a top view of hinge 100 in a closed position attached to frame 8.

Hinge 100 comprises a hinge cup 110, a top hinge arm segment 140, a base hinge arm segment 120 and an L-shaped hinge arm segment 130. Hinge cup 110 is mountable flush in a bore hole in the back of a door with fastening screws 117 in a known manner, and includes a spring 116 so as to facilitate automatic closing of a door once the hinge has been partially closed. Base hinge arm segment 120 is adapted to be affixed to a frame 8.

Top hinge arm segment 140 comprises an elongated aperture 142 and two tabs 145. Base hinge arm segment 120 comprises an elongated center hole 122, a circular aperture 124 and an upper flange 126. L-shaped hinge arm segment 130 comprises a center hole 132, a circular aperture 136, an elongated aperture 134, a retaining wall 133 and two grooves 135.

Top hinge arm segment 140 comprises an arm end pivotably attached to hinge cup 110 on a pivot axis via hinge pin 119. Top hinge arm segment 140 is slideably connected to L-shaped hinge arm segment 130 by sliding top hinge arm segment 140 between the flaps 138 and securing with a first cam or eccentric screw 113 via the elongated aperture 142 in the top hinge arm segment 140 and the circular aperture 136 in the L-shaped hinge arm segment 130. Base hinge arm segment 120 is slideably connected to L-shaped hinge arm segment 130 with a second cam or eccentric screw 114 via the elongated aperture 134 in the L-shaped hinge arm segment 130 and the circular aperture 124 in the base hinge arm segment 120. Finally, top hinge arm segment 140 is adjustably connected to L-shaped hinge arm segment 130 via first cam or eccentric screw 113. First cam or eccentric screw 113 cooperates with the open-ended elongated aperture 142 in top hinge arm segment 140 and the circular aperture 136 in L-shaped hinge arm segment 130 to allow horizontally arcing adjustments to be made (i.e., side to side adjustments).

Three-dimensional adjustments can be made with hinge 100. First, the elongated center hole 122 in base hinge arm segment 120 accepts a fastening screw 117, thereby attaching the base hinge arm segment 120 of hinge arm portion 115 to frame 8 while also allowing vertical up and down adjustments to be made easily so that the desired spacing of the door from the top and bottom of the cabinet door opening can be adjusted. Second, when first cam or eccentric screw 113 is turned, L-shaped hinge arm segment 130 moves relative to top hinge arm segment 140 in a horizontally arcing direction, thereby allowing side-to-side adjustments to be made so that the desired spacing of the doors from the opposite sides of the cabinet door openings can be adjusted.

Third, when second cam screw 114 is turned, L-shaped hinge arm segment 130 moves relative to base hinge arm segment 120 in a horizontal in and out direction so that the desired alignment of the front face of the door with the front of the cabinet can be adjusted.

Figure 6:
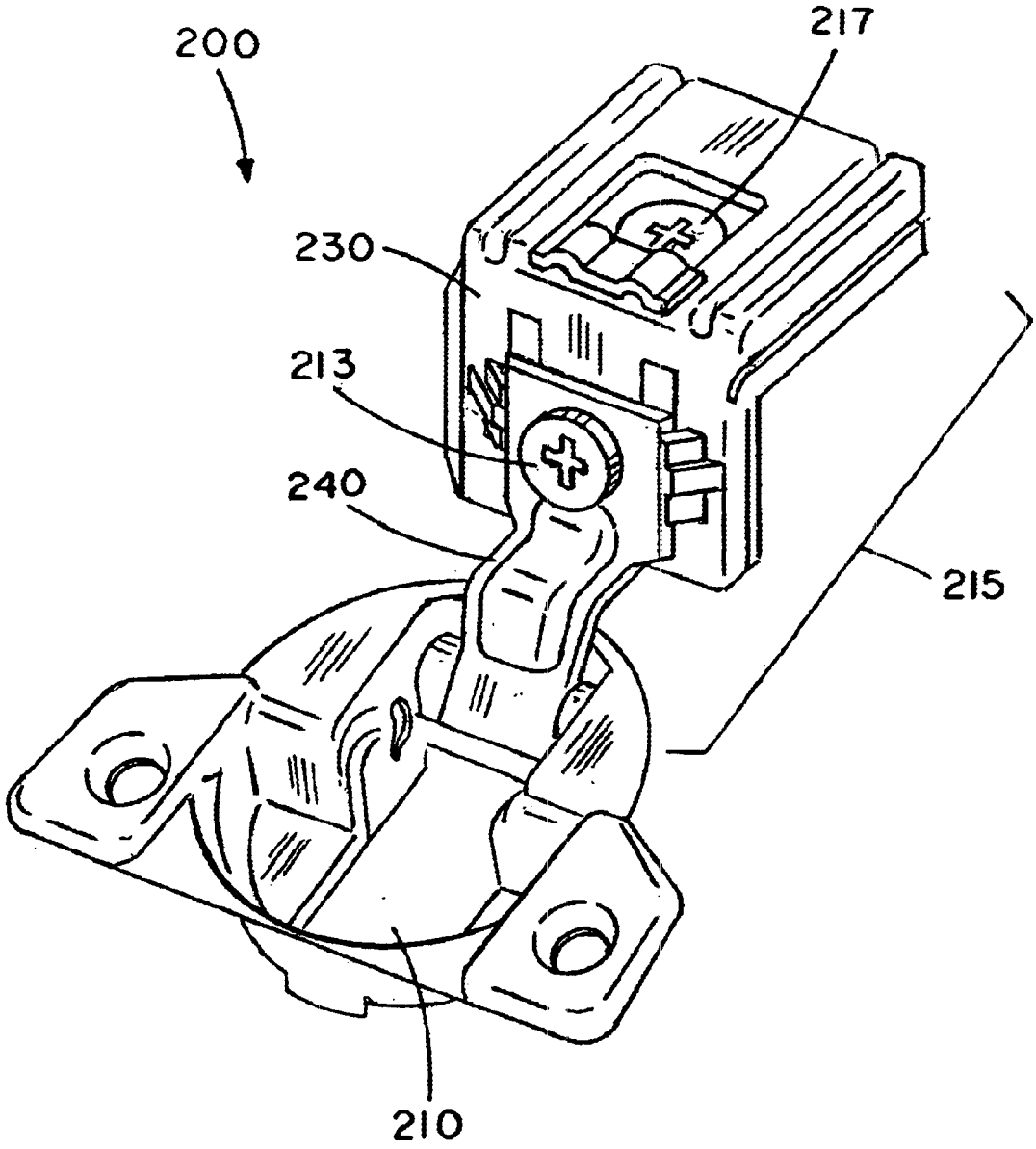
FIG. 6 is a top perspective view of one embodiment of a two-dimensionally adjustable hinge of the present invention comprising a two-piece hinge arm construction.
Figure 7:
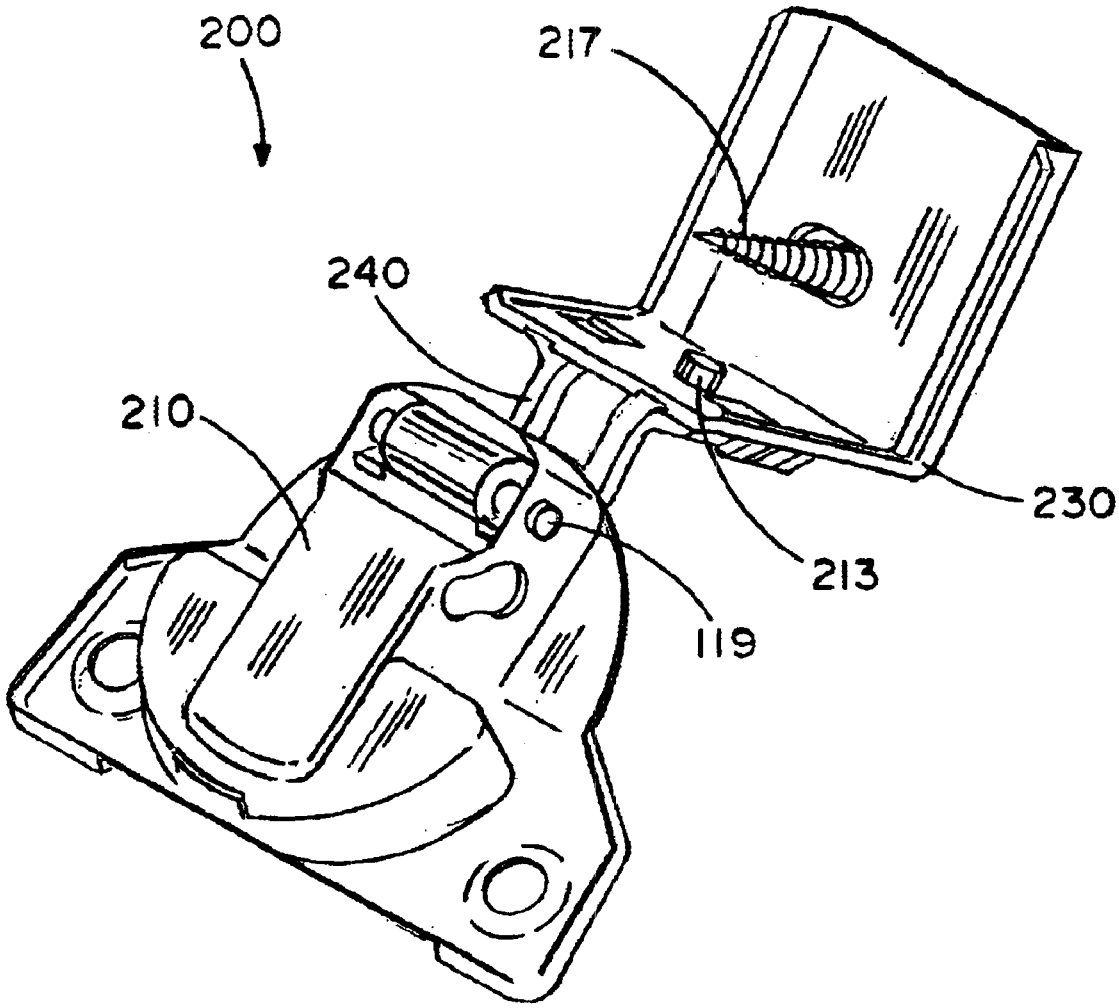
FIG. 7 is a bottom perspective view of the adjustable hinge shown in FIG. 6.
Figure 8:
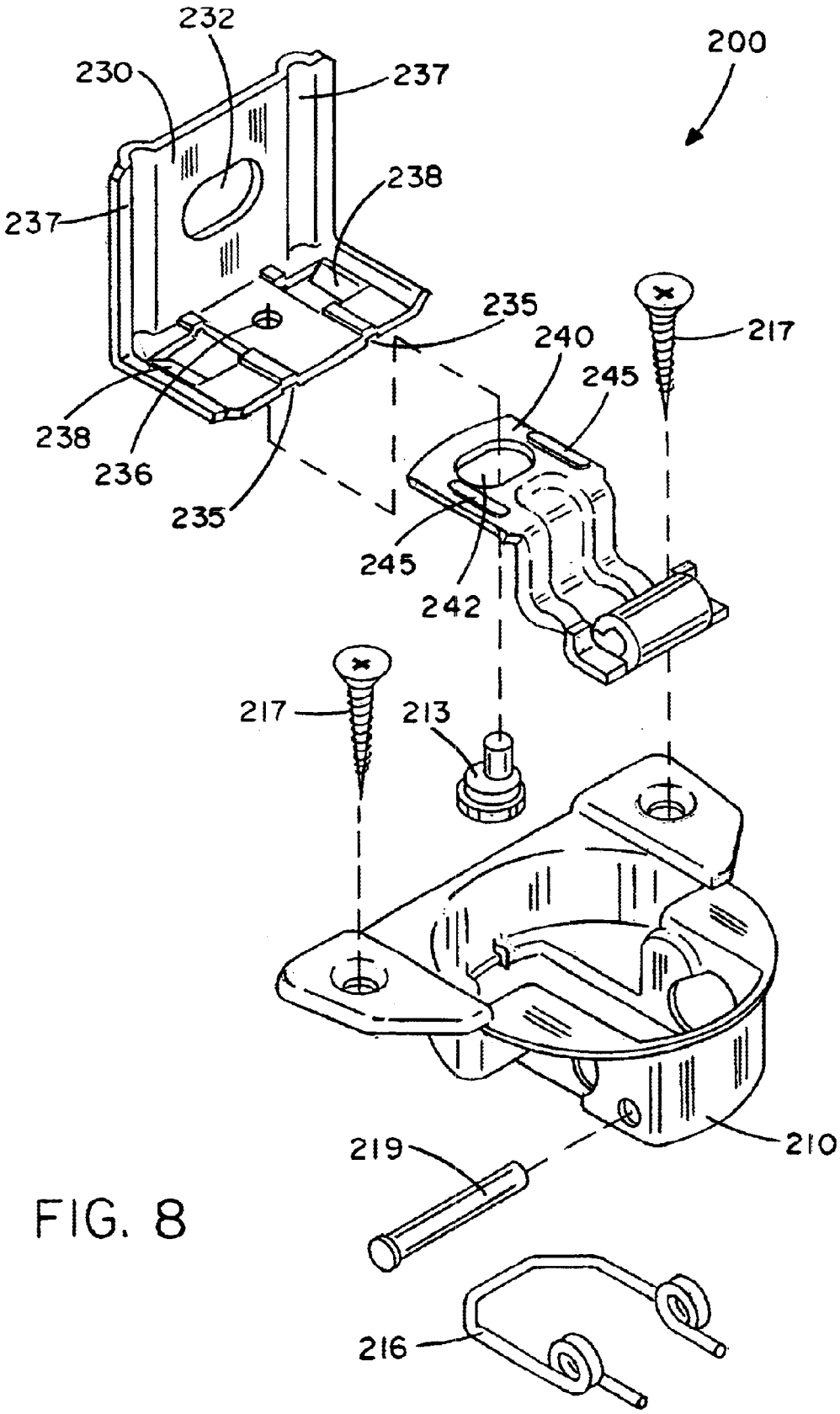
FIG. 8 is an exploded view of the adjustable hinge shown in FIG. 6.

Referring now to FIGS. 6–8, there is shown various views of one embodiment of a two-dimensionally adjustable hinge 200 of the present invention comprising a two-piece hinge arm construction. FIG. 6 shows a top perspective view of hinge 200 in an open position, and FIG. 7 shows a bottom perspective view of hinge 200. FIG. 8 shows an exploded view of hinge 200 so that all the individual parts of hinge 200 can be more readily seen and understood.

Hinge 200 comprises a hinge cup 210, a top hinge arm segment 240, and an L-shaped hinge arm segment 230. Hinge cup 210 is mountable flush in a bore hole in the back of a door with fastening screws 217 in a known manner, and includes a spring 216 so as to facilitate automatic closing of a door once the hinge has been partially closed. Base hinge arm segment 220 is adapted to be affixed to a door frame 8.

Top hinge arm segment 240 has an arm end pivotably attached to hinge cup 210 on a pivot axis via hinge pin 219. Top hinge arm segment 240 is slideably connected to L-shaped hinge arm segment 230 with a first cam or eccentric screw 213 via the elongated aperture 242 in the top hinge arm segment 240 and the circular aperture 236 in the L-shaped hinge arm segment 230.

Top hinge arm segment 240 is slideably connected to L-shaped hinge arm segment 230 by sliding the top hinge arm segment 240 between the flaps 238 on the L-shaped hinge arm segment 230 and securing with the first cam or eccentric screw 213. First cam or eccentric screw 213 cooperates with the open-ended elongated aperture 242 in top hinge arm segment 240 and the circular aperture 236 in base hinge arm segment 230 to allow horizontally arcing adjustments to be made (i.e., side to side adjustments).

Only two-dimensional adjustments can be made with hinge 200. First, the elongated center hole 232 in L-shaped hinge arm segment 230 accepts a fastening screw 217, thereby attaching the L-shaped hinge arm segment 230 of hinge arm portion 215 to a frame while also allowing vertical up and down adjustments to be made easily so that the desired spacing of the door from the top and bottom of the cabinet door opening can be adjusted. Second, when first cam or eccentric screw 213 is turned, top hinge arm segment 240 moves relative to L-shaped hinge arm segment 230 in a horizontally arcing direction, thereby allowing side-to-side adjustments to be made so that the desired spacing of the doors from the opposite sides of the cabinet door openings can be adjusted. Since there is no base hinge arm segment and no second or eccentric screw in this embodiment, no horizontal in and out adjustments can be made, so the desired alignment of the front face of the door with the front of the cabinet cannot be adjusted.

Figure 9:
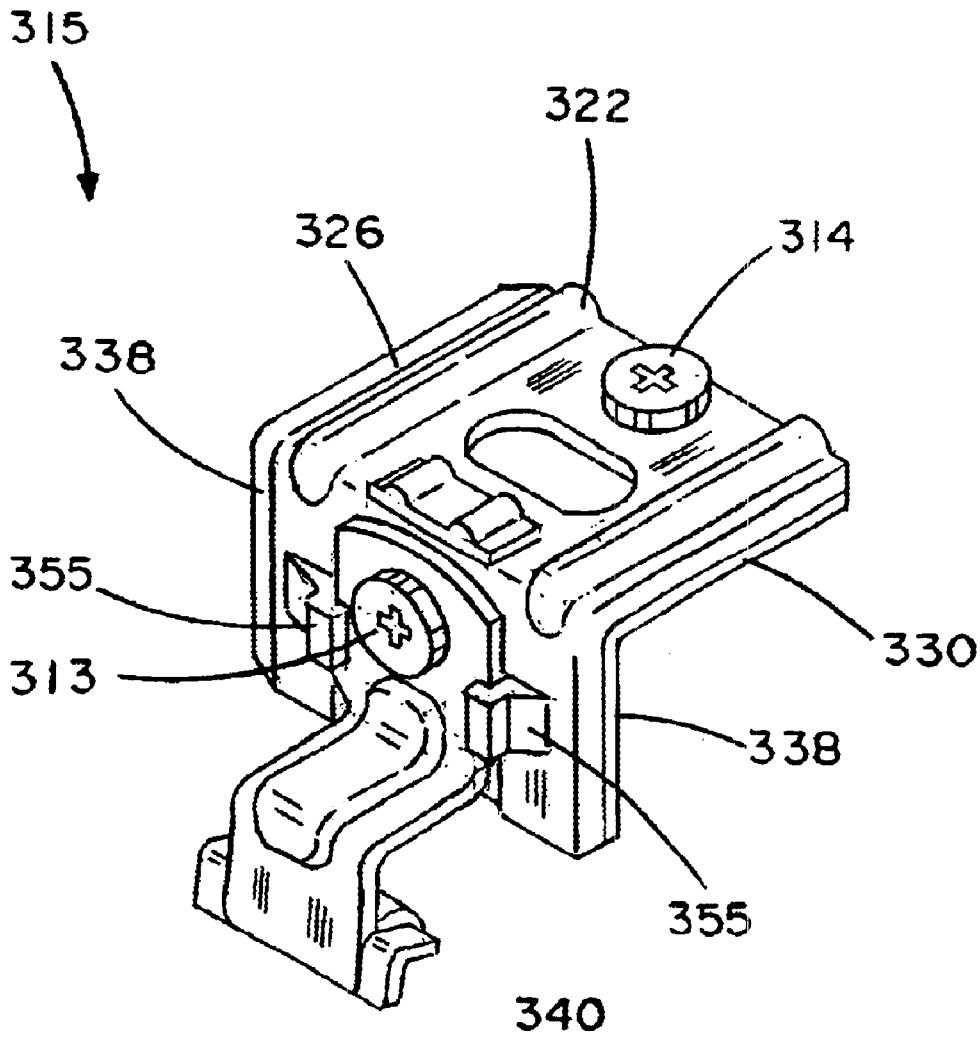
FIG. 9 is a top perspective view of another embodiment of a threeionally dimensionally adjustable hinge of the present invention comprising an intermediate hinge arm segment.
Figure 10:
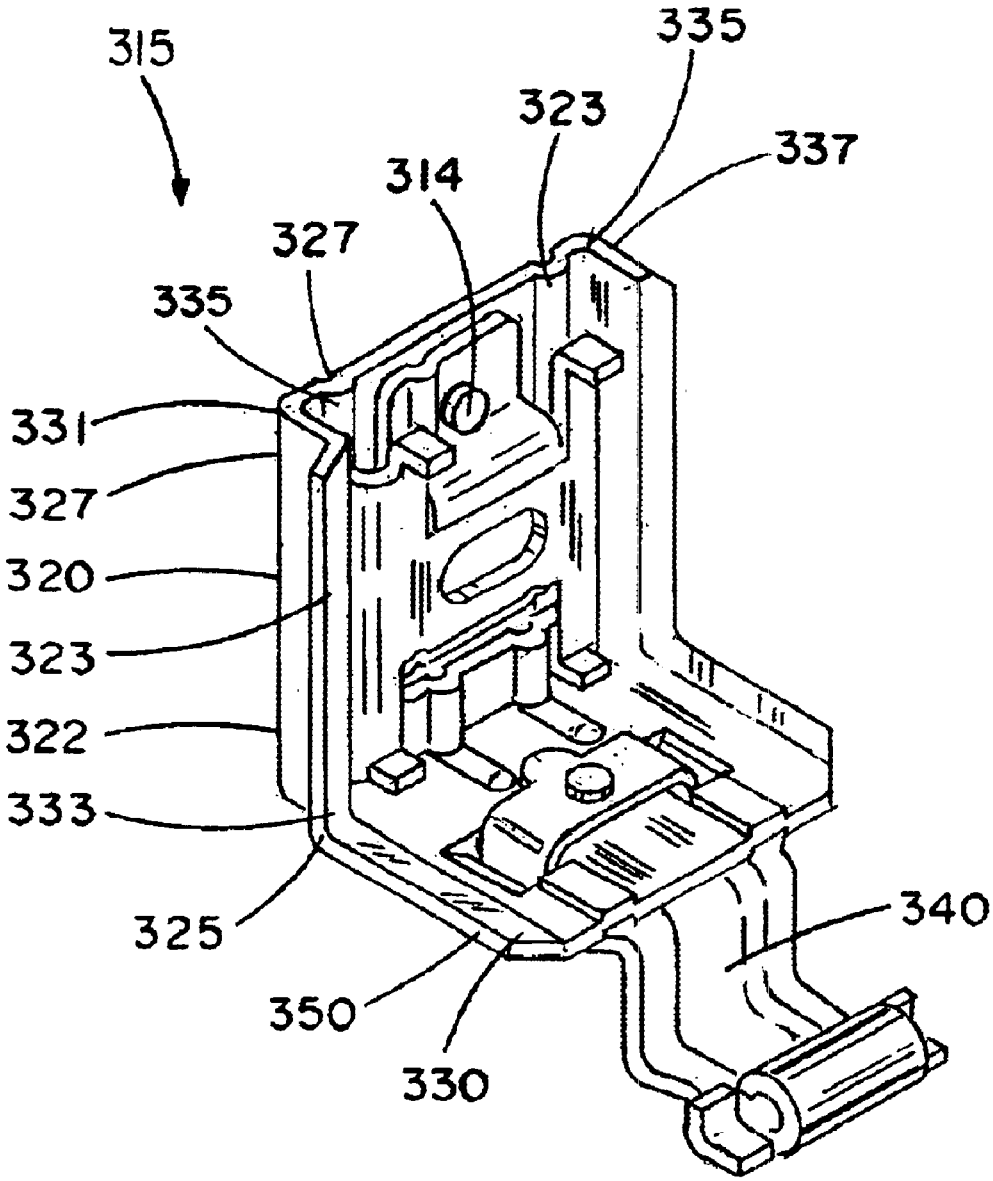
FIG. 10 is a bottom perspective view of the adjustable hinge shown in FIG. 9.
Figure 11:
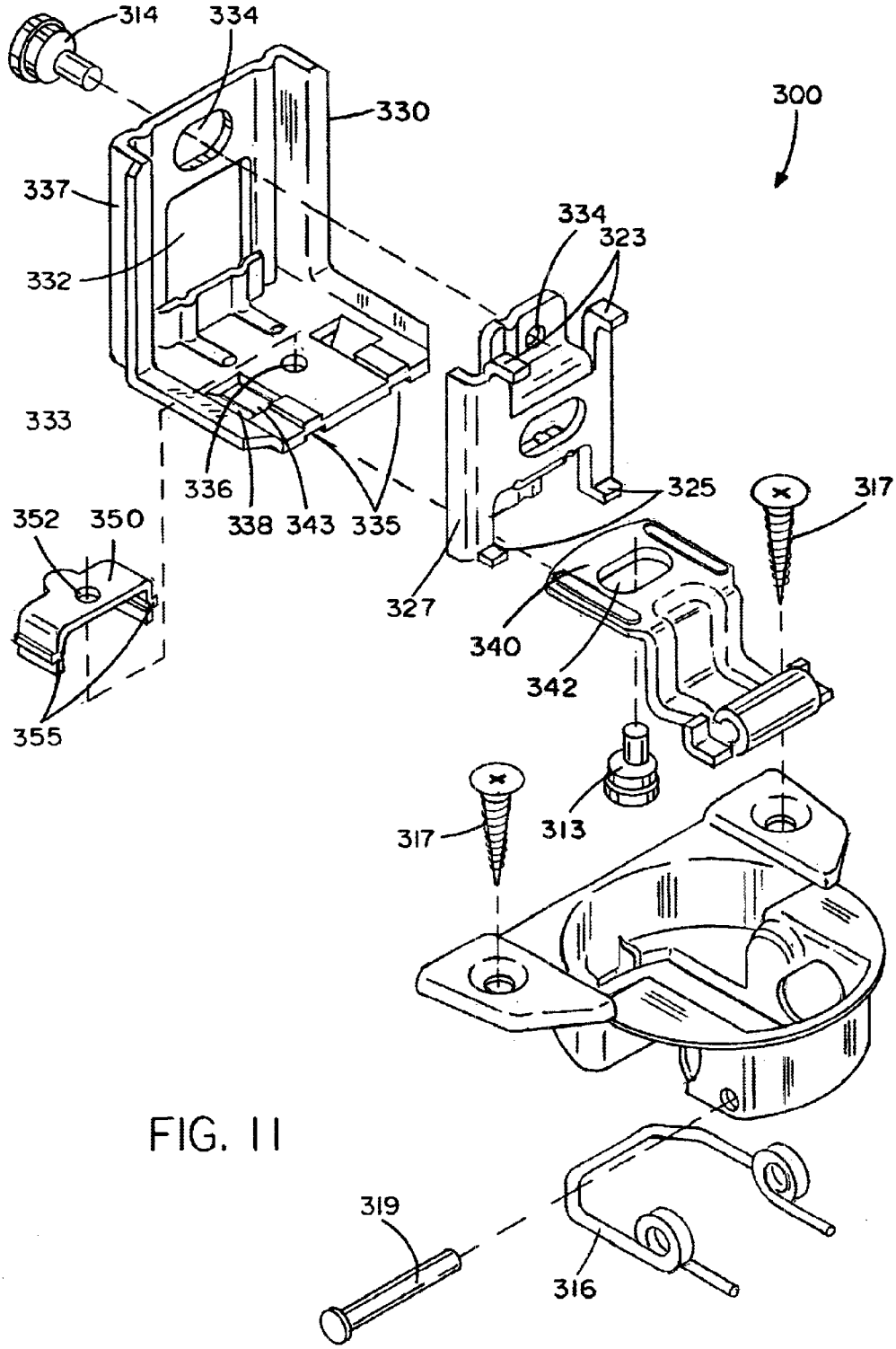
FIG. 11 is an exploded view of the adjustable hinge shown in FIGS. 9 and 10.

FIGS. 9–11, show various views of one embodiment of a three-dimensionally adjustable hinge 300 of the present invention comprising a four-piece hinge arm construction. FIG. 9 shows a top perspective view of hinge 300, and FIG. 10 shows a bottom perspective view of hinge 300. FIG. 11 shows an exploded view of a three-dimensionally adjustable hinge 300 so that all the individual parts of hinge 300 can be more readily seen and understood.

Figure 12:
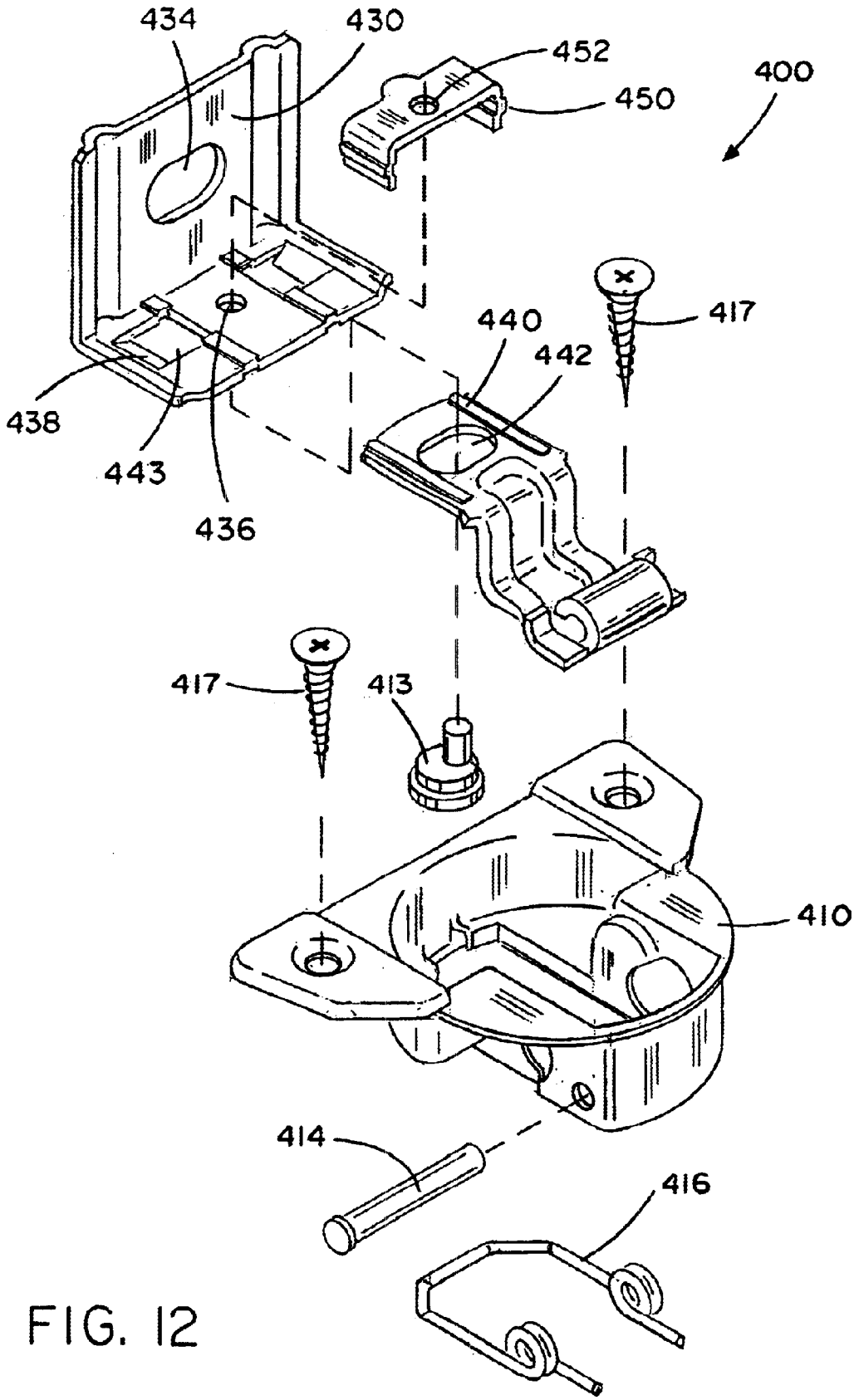
FIG. 12 is an exploded view of an embodiment of a two-dimensionally adjustable hinge of the present invention comprising an intermediate hinge arm segment.

FIG. 12 shows an exploded view of a two-dimensionally adjustable hinge 300 so that all the individual parts of hinge 300 can be more readily seen and understood.

Referring now to FIGS. 9–11, hinge 300 comprises a hinge cup 310, a top hinge arm segment 340, a base hinge arm segment 320 and an L-shaped hinge arm segment 330 and an intermediate hinge arm segment 350. Hinge cup 310 is mountable flush in a bore hole in the back of a door with fastening screws 317 in a known manner, and includes a spring 316 so as to facilitate automatic closing of a door once the hinge has been partially closed. Base hinge arm segment 320 is adapted to be affixed to a frame 8.

Top hinge arm segment 340 comprises an elongated aperture 342 and two tabs 345. Base hinge arm segment 320 comprises an elongated center hole 322, a circular aperture 324 and an upper flange 326. L-shaped hinge arm segment 330 comprises a center hole 332, a circular aperture 336, an elongated aperture 334, a retaining wall 333 and two grooves 335. Intermediate hinge arm segment 350 comprises a center hole 352 and two retaining ledges 355.

Top hinge arm segment 340 comprises an arm end pivotably attached to hinge cup 310 on a pivot axis via hinge pin 319. Top hinge arm segment 340 is slideably connected to L-shaped hinge arm segment 330 with a first cam or eccentric screw 313 via the elongated aperture 342 in the top hinge arm segment 340 and the circular aperture 336 in the L-shaped hinge arm segment 330. Base hinge arm segment 320 is slideably connected to L-shaped hinge arm segment 330 with a second cam or eccentric screw 314 via the elongated aperture 334 in the L-shaped hinge arm segment 330 and the circular aperture 324 in the base hinge arm segment 320. Finally, top hinge arm segment 340 is adjustably connected to L-shaped hinge arm segment 330 via first cam or eccentric screw 313. First cam or eccentric screw 313 cooperates with the open-ended elongated aperture 342 in top hinge arm segment 340, the circular aperture 336 in L-shaped hinge arm segment 330, and the center hole 352 in intermediate hinge arm segment 350 to allow horizontally arcing adjustments to be made (i.e., side to side adjustments).

Intermediate hinge arm segment 350 is connected to L-shaped hinge arm segment 330 by insertion of the retaining ledges 355 of the intermediate hinge arm segment 350 into the slots 343 of the L-shaped hinge arm segment 330 until the retaining ledges 355 extend past the retaining ramps 338. The distance between the inner edges of the retaining ramps 338 is slightly smaller than the distance between the retaining ledges 355 such that intermediate hinge arm segment 350 is kept in place through friction between the retaining ramps 338 and the retaining ledges 355.

L-shaped hinge arm segment 330 comprises a pair of opposing slots 343 through which the opposing retaining ledges 355 of the somewhat U shaped intermediate hinge arm segment 350 extend upwardly to slideably capture the edges of the top hinge arm segment 340. The intermediate hinge arm segment 350 holds the top hinge arm segment 340 against the L-shaped hinge arm segment 330. The first cam or eccentric screw 313 is then inserted through the elongated aperture 342 in the top hinge arm segment 340, the circular aperture 336 in the L-shaped hinge arm segment 330 and the center hole 352 in the intermediate hinge arm segment 350.

Figure 13:
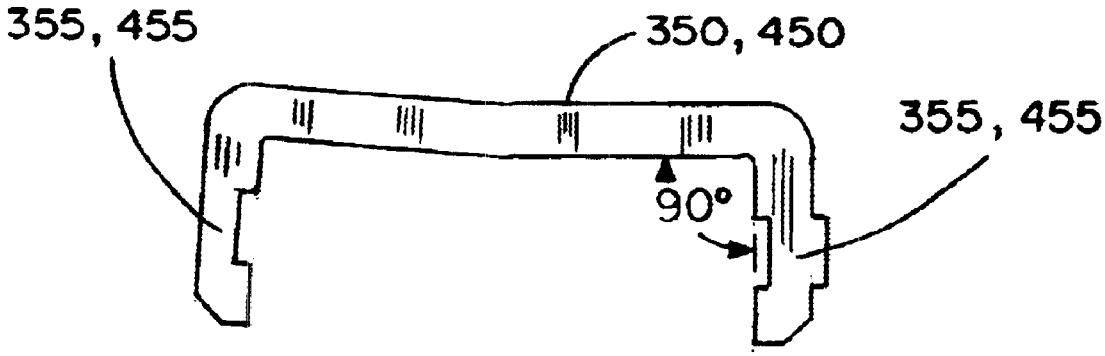
FIG. 13 is a side view of an embodiment of an intermediate hinge arm segment of the present invention.

Intermediate hinge arm segment 350 is generally U shaped, however it may have a slight deflection of between 0 and 3 degrees shown as angle alpha in FIG. 13. In a preferred embodiment angle alpha is about 1.5 degrees. This creates a level of spring tension between the retaining ramps 338, retaining ledges 355 and the intermediate hinge arm segment 350.

Three-dimensional adjustments can be made with hinge 300. First, the elongated center hole 322 in base hinge arm segment 320 accepts a fastening screw 317, thereby attaching the base hinge arm segment 320 of hinge arm portion 315 to frame 8 while also allowing vertical up and down adjustments to be made easily so that the desired spacing of the door from the top and bottom of the cabinet door opening can be adjusted. Second, when first cam or eccentric screw 313 is turned, L-shaped hinge arm segment 330 moves relative to top hinge arm segment 340 in a horizontally arcing direction, thereby allowing side-to-side adjustments to be made so that the desired spacing of the doors from the opposite sides of the cabinet door openings can be adjusted. Third, when second cam screw 314 is turned, L-shaped hinge arm segment 330 moves relative to base hinge arm segment 320 in a horizontal in and out direction so that the desired alignment of the front face of the door with the front of the cabinet can be adjusted.

FIG. 12 shows hinge 400. Hinge 400 comprises a hinge cup 410, a top hinge arm segment 440, an L-shaped hinge arm segment 430 and an intermediate hinge arm segment 450. Hinge cup 410 is mountable flush in a bore hole in the back of a door with fastening screws 417 in a known manner, and includes a spring 416 so as to facilitate automatic closing of a door once the hinge has been partially closed. L-shaped hinge arm segment 430 is adapted to be affixed to a furniture frame or other mounting platform. A mounting screw 417 may be affixed to a furniture frame 8 through the elongated aperture 434 on the L-shaped hinge arm segment 430.

Top hinge arm segment 440 comprises an arm end pivotably attached to hinge cup 410 on a pivot axis via hinge pin 419. Top hinge arm segment 340 is slideably connected to L-shaped hinge arm segment 430 with a first cam or eccentric screw 313 via the elongated aperture 442 in the top hinge arm segment 440 and the circular aperture 436 in the L-shaped hinge arm segment 430.

Top hinge arm segment 440 is adjustably connected to L-shaped hinge arm segment 430 via first cam or eccentric screw 413. First cam or eccentric screw 413 cooperates with the open-ended elongated aperture 442 in top hinge arm segment 440 and the circular aperture 436 in base hinge arm segment 430 to allow horizontally arcing adjustments to be made (i.e., side to side adjustments).

Intermediate hinge arm segment 450 is connected to L-shaped hinge arm segment 430 by insertion of the retaining ledges 455 of the intermediate hinge arm segment 450 into the slots 443 of the L-shaped hinge arm segment 430 until the retaining ledges 455 extend past the retaining ramps 438. The distance between the inner edges of the retaining ramps 438 is slightly smaller than the distance between the retaining ledges 455 such that intermediate hinge arm segment 450 is kept in place through friction between the retaining ramps 438 and the retaining ledges 455.

Intermediate hinge arm segment 450 is generally U shaped, however it may have a slight deflection of between 0 and 3 degrees shown as angle alpha in FIG. 13. In a preferred embodiment angle alpha is about 1.5 degrees. This creates a level of spring tension between the retaining ramps 438, retaining ledges 455 and the intermediate hinge arm segment 450.

Only two-dimensional adjustments can be made with this embodiment of hinge 400. First, the elongated center hole 432 in L-shaped hinge arm segment 430 accepts a fastening screw 417, thereby attaching the L-shaped hinge arm segment 430 of hinge arm portion 415 to a frame while also allowing vertical up and down adjustments to be made easily so that the desired spacing of the door from the top and bottom of the cabinet door opening can be adjusted. Second, when first cam or eccentric screw 413 is turned, top hinge arm segment 440 moves relative to L-shaped hinge arm segment 430 in a horizontally arcing direction, thereby allowing side-to-side adjustments to be made so that the desired spacing of the doors from the opposite sides of the cabinet door openings can be adjusted. Since there is no base hinge arm segment and no second or eccentric screw in this embodiment, no horizontal in and out adjustments can be made, so the desired alignment of the front face of the door with the front of the cabinet cannot be adjusted.

Referring to all the figures, the first cam or eccentric screws 113, 213, 313, 413 used in this invention may comprise a threaded portion proximate the head of the screw, and an unthreaded portion at the other end of the screw. The unthreaded portion engages an unthreaded circular aperture (i.e., circular aperture 136, 226, 336, 436) in one of the L-shaped hinge arm segments 130, 230, 330, 430 as well as the center hole 352, 452 in intermediate hinge arm segment 350, 450. The threaded portion then engages the open-ended elongated aperture 142, 242, 342, 442 in the top hinge arm segment.

In embodiments of the present invention, the open-ended elongated apertures 142, 242, 342, 442 have no threads, thereby saving the secondary operation of threading those openings. Instead of threading those apertures 142, 242, 342, 442one side of the aperture may be displaced horizontally in front of the other so as to receive and match the pitch of the threads on the adjustment screw 113, 213, 313, 413. The horizontal displacement between the sides of the elongated apertures 142, 242, 342, 442 are preferably slightly greater than the horizontal distance between the valleys on the opposite sides of the adjustment screw threads, thereby creating tension to hold the adjustment screw 113, 213, 313, 413 in position. Apertures 142, 242, 342, 442 are purposely elongated so as to allow the hinge arm portion 115, 215, 315, 415 of the hinges 100, 200, 300, 400 to pivot in an arc as the respective adjustment screw 113, 213, 313, 413 is turned.

In embodiments of this invention the first cam or eccentric screw 113, 213, 313 ,413 and the second cam or eccentric screw 114, 314, may be flared at its distal end to hold the cam or eccentric screw in place.

In some embodiments, at least one of the hinge arm segments further comprises opposing lateral edges from which depend a pair of opposing side members that define a channel for receiving another hinge arm segment. The opposing lateral edges are preferably spaced from one another a distance that defines a width of the hinge arm segment. The width of each hinge arm segment is determined so that the various hinge arm segments can nest together. For example, in hinge 100, the L-shaped hinge arm segment 130 and the base hinge arm segment 120 may both have opposing side members 137, 127 that define the width of the respective segments, with the width of the base hinge arm segment 120 being slightly less than the width of the top hinge arm segment 130 so that the opposing side members 127 of the base hinge arm segment 120 nest within the opposing side members 137 of the L-shaped hinge arm segment 130. Alternatively, all three of these hinge arm segments 140, 130, 120 could have opposing side members defining the width of each respective segment, with the widths of the segments varying so that the opposing side members of all three hinge arm segments nest together one within another. Other embodiments of the hinges of the present invention may be similarly designed to include such opposing side members.

The three-dimensional adjustment aspect of some embodiments of the adjustable hinge of the present invention not only allows adjustment of the position of a cabinet door vertically up-and-down relative to the supporting cabinet (i.e., up and down in direction X with the door in the closed position to achieve desired spacing of the door from the top and bottom of the cabinet door opening) and horizontally in-and-out relative to the supporting cabinet (i.e., to and fro in direction Y with the door in the closed position to achieve desired alignment of the front face of the door with the front of the cabinet), but also enables adjustment of the cabinet door horizontally from side-to-side relative to the supporting cabinet (i.e., from side to side in direction Z with the door in the closed position to achieve desired spacing of the door from the opposite sides of the cabinet door opening). Direction Y comes straight out of the paper in FIG. 1.

In a two-dimensionally adjustable embodiment, the base hinge arm segment is omitted. In these embodiments the L-shaped hinge arm segment 230, 430 is adapted to be fastened to the furniture article 8 by at least one fastening screw 217, 417, inserted preferably, through the elongated center hole 232, 432 in the L-shaped hinge arm segment 230, 430. In embodiments, the elongated center hole 232, 432 of the L-shaped hinge arm segment 230, 430 is adapted to allow the L-shaped hinge arm segment 230, 430 top be displaced relative to the furniture article frame 8 in a vertical direction.

Embodiments of the three-dimensionally adjustable hinges of the present invention may also include, for example, a base hinge arm segment 120, 320 comprising an elongated center hole 122, 322 that extends parallel to the pivot axis of the hinge 100, 300, respectively. The L-shaped hinge arm segments 130, 330 preferably have a center hole 132, 332 that is somewhat rectangular and larger than the center hole 122, 322 of the base hinge arm segment 120, 320. The top hinge arm segment 140, 340 preferably comprises a center hole 142, 342 that is also somewhat rectangular and larger than the center hole 136, 336 of the L-shaped hinge arm segment 130, 330. In embodiments, the base hinge arm segments 120, 320 are adapted to be fastened on the furniture article frame 8 by at least one mounting screw 117, 317 inserted, preferably, through the elongated center hole 122, 322 of the base hinge arm segment 120, 320. In embodiments, the elongated center hole 122, 322 in the base hinge arm segment is adapted to allow the base hinge arm segment 120, 320 to be displaced relative to the furniture article frame 8 in a vertical direction (when the hinge is in its mounted and closed position) parallel to the pivot axis of the hinge by loosening the single mounting screw 117, 317.

The second cam or eccentric screw 114, 314, is generally mounted in a hinge arm segment by means of a projection, and then extends through an elongated opening in another hinge arm segment to hold the two hinge arm segments together. The cam or eccentric screw is rotatable about a central axis thereof, and the projection extends parallel to the central axis of the cam or eccentric screw and is radially offset therefrom.

In hinge 100, the second cam or eccentric screw 114 is mounted in the circular aperture 124 in base hinge arm segment 120 by means of a projection, and the second cam or eccentric screw 114 then extends through the elongated slot 134 in the L-shaped hinge arm segment 130. The elongated slot 134 in the L-shaped hinge arm segment 130 extends parallel to the pivot axis of the hinge 100. Turning this second cam or eccentric screw 114 causes the L-shaped hinge arm segment 130 to be displaced on the base hinge arm segment 120 in a direction perpendicular to the pivot axis of hinge 100.

In hinge 300, the second cam or eccentric screw 314 (if there is one) is mounted in the base hinge arm segment 320 by means of a projection in circular aperture 324, and the second cam or eccentric screw 314 then extends through the elongated center hole 334 in the L-shaped hinge arm segment 330. The elongated center hole 334 in the L-shaped hinge arm segment 330 extends perpendicular to the pivot axis of the hinge 300. Turning this second cam or eccentric screw 314 causes the L-shaped hinge arm segment 330 to be displaced on the base hinge arm segment 320 in a direction perpendicular to the pivot axis of hinge 300 (i.e., horizontally in and out).

The base hinge arm segment 120 of the hinge component 100 for embodiments of the present invention comprises a pair of back legs 123 that rest against a back side of the face of frame 8 and a pair of front legs 125 that rest against a front side of the face of frame 8 in a mounted condition of the base hinge arm segment 120. Legs 123, 125 ensure that the hinge arm portion 115 of the hinge 100 remains stable and in position once the doors are hung from the hinge 100. The base hinge arm segments 220, 320 of the other embodiments described herein may also be configured to included legs like legs 123, 125.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of various embodiments of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a furniture article frame for movement between open and closed positions of the door relative to the furniture article frame, comprising:

a hinge cup member adapted to be affixed to the door;

a top hinge arm segment pivotably connected at its arm end to the hinge cup member and comprising an elongated aperture and two tabs;

an L-shaped hinge arm segment comprising a center hole, a circular aperture, an elongated aperture and two flaps;

a base hinge arm segment comprising an elongated center hole, a circular aperture and an upper flange and being adapted to be fastened on the furniture article frame by at least one mounting screw inserted through the base elongated center hole;

a first cam screw; and a second cam screw, wherein the top hinge arm segment is pivotably connected to the hinge cup member on a first pivot axis, the top hinge arm segment is slideably connected to the L-shaped hinge arm segment with a first cam screw, the base hinge arm segment is slideably connected to the L-shaped hinge arm segment by a second cam screw cooperating with the elongated aperture in the L-shaped hinge arm segment and the circular aperture in the base hinge arm segment;

wherein the base elongated center hole allows vertical adjustments to be made in a direction parallel to the first pivot axis of the hinge;

wherein turning the first cam screw causes the top hinge arm segment to move relative to the L-shaped hinge arm segment in a horizontally side to side direction perpendicular to the first pivot axis of the hinge; and wherein turning the second cam screw causes the L-shaped hinge arm segment to move relative to the base hinge arm segment in a horizontal direction perpendicular to the first pivot axis of the hinge.

2. The hinge of claim 1, wherein the base elongated center hole is elongated in a direction parallel to the first pivot axis of the hinge and is adapted to allow the base hinge arm segment to be displaced relative to the furniture article frame in a direction parallel to the first pivot axis of the hinge by loosening the mounting screw.

3. The hinge of claim 1, wherein the first cam screw is rotatable about a central axis thereof, wherein a projection extends from one end of the first cam screw parallel to the central axis thereof, and wherein the projection is radially offset from the central axis of the first cam screw.

4. The hinge of claim 1, wherein the second cam screw is rotatable about a central axis thereof, wherein a projection extends from one end of the second cam screw parallel to the central axis thereof, and wherein the projection is radially offset from the central axis of the second cam screw.

5. The hinge of claim 1, wherein the top hinge arm segment is slideably connected to the L-shaped hinge arm segment by sliding the top hinge arm segment between the flaps on the L-shaped hinge arm segment.

6. The hinge of claim 1, wherein at least one of the top hinge arm segment, the L-shaped hinge arm segment and base hinge arm segment further comprise opposing lateral edges and a pair of opposing side members depending therefrom to define a channel for receiving the another hinge arm segment.

7. The hinge of claim 6, wherein at least one more of the top hinge arm segment, the L-shaped hinge arm segment and base hinge arm segment further comprise opposing lateral edges and a pair of opposing side members depending therefrom to define a channel for inserting into the channel of another hinge arm segment.

8. The hinge of claim 1, wherein the base hinge arm segment further comprises a pair of back legs that rest against a back side of the furniture article frame and a pair of front legs that rest against a front side of the furniture article frame to ensure that the base hinge arm segment remains stable and in position once the door is attached to the hinge.

9. A hinge for mounting a door on a furniture article frame for movement between open and closed positions of the door relative to the furniture article frame, comprising:

a hinge cup member adapted to be affixed to the door;

a top hinge arm segment pivotably connected at its arm end to the hinge cup member and comprising an elongated aperture and two tabs;

an L-shaped hinge arm segment comprising a center hole, a circular aperture, an elongated aperture and two flaps; and a first cam screw;

wherein the top hinge arm segment is pivotably connected to the hinge cup member on a first pivot axis, and the top hinge arm segment is slideably connected to the L-shaped hinge arm segment with the first cam screw;

wherein turning the first cam screw causes the top hinge arm segment to move relative to the L-shaped hinge arm segment in a horizontally side to side direction perpendicular to the first pivot axis of the hinge.

10. The hinge of claim 9, wherein the L-shaped hinge arm segment center hole comprises a mounting screw therethrough to secure the L-shaped hinge arm segment to the furniture article frame and wherein said center hole is elongated in a direction parallel to the first pivot axis of the hinge and is adapted to allow the L-shaped hinge arm segment to be displaced relative to the furniture article frame in a direction parallel to the first pivot axis of the hinge by loosening the mounting screw.

11. The hinge of claim 9, wherein the first cam screw is rotatable about a central axis thereof, wherein a projection extends from one end of the first cam screw parallel to the central axis thereof, and wherein the projection is radially offset from the central axis of the first cam screw.

12. The hinge of claim 9, wherein the top hinge arm segment is slideably connected to the L-shaped hinge arm segment by sliding the top hinge arm segment between the flaps on the L-shaped hinge arm segment.

13. A hinge for mounting a door on a furniture article frame for movement between open and closed positions of the door relative to the furniture article frame, comprising:

a hinge cup member adapted to be affixed to the door;

a top hinge arm segment pivotably connected at its arm end to the hinge cup member and comprising an elongated aperture and two tabs;

an L-shaped hinge arm segment comprising a center hole, a circular aperture, an elongated aperture and two retaining ramps;

an intermediate hinge arm segment comprising a circular aperture and two retaining ledges;

a base hinge arm segment comprising an elongated center hole, a circular aperture and an upper flange and being adapted to be fastened on the furniture article frame by at least one mounting screw inserted through the base elongated center hole;

a first cam screw; and a second cam screw;

wherein the top hinge arm segment is pivotably connected to the hinge cup member on a first pivot axis, the top hinge arm segment is slideably connected to the L-shaped hinge arm segment with a first cam screw, the base hinge arm segment is slideably connected to the L-shaped hinge arm segment by a second cam screw cooperating with the elongated aperture in the L-shaped hinge arm segment and the circular aperture in the base hinge arm segment;

wherein the base elongated center hole allows vertical adjustments to be made in a direction parallel to the first pivot axis of the hinge;

wherein turning the first cam screw causes the top hinge arm segment to move relative to the L-shaped hinge arm segment in a horizontally side to side direction perpendicular to the first pivot axis of the hinge; and wherein turning the second cam screw causes the L-shaped hinge arm segment to move relative to the base hinge arm segment in a horizontal direction perpendicular to the first pivot axis of the hinge.

14. The hinge of claim 13, wherein the base elongated center hole is elongated in a direction parallel to the first pivot axis of the hinge and is adapted to allow the base hinge arm segment to be displaced relative to the furniture article frame in a direction parallel to the first pivot axis of the hinge by loosening the mounting screw.

15. The hinge of claim 13, wherein the first cam screw is rotatable about a central axis thereof, wherein a projection extends from one end of the first cam screw parallel to the central axis thereof, and wherein the projection is radially offset from the central axis of the first cam screw.

16. The hinge of claim 13, wherein the second cam screw is rotatable about a central axis thereof, wherein a projection extends from one end of the second cam screw parallel to the central axis thereof, and wherein the projection is radially offset from the central axis of the second cam screw.

17. The hinge of claim 13, wherein the top hinge arm segment is slideably connected to the L-shaped hinge arm segment by sliding the top hinge arm segment between the two retaining ledges on the intermediate hinge arm segment.

18. The hinge of claim 13 wherein, the intermediate hinge arm segment is fixedly-attached to the two retaining ramps of the L-shaped hinge arm segment via the two retaining ledges on the intermediate hinge arm segment, the L-shaped hinge arm segment and the intermediate hinge arm segments are adjustably connected to the top hinge arm segment with a first cam screw via the elongated aperture in the top hinge arm segment and the circular aperture in the L-shaped hinge arm segment and the circular aperture in the intermediate hinge arm segment.

19. The hinge of claim 13, wherein the intermediate hinge arm segment has a deflection of between 0 and 3 degrees.

20. The hinge of claim 19, wherein the intermediate hinge arm segment has a deflection of about 1.5 degrees.

21. The hinge of claim 13, wherein at least one of the top hinge arm segment, the L-shaped hinge arm segment and base hinge arm segment further comprise opposing lateral edges and a pair of opposing side members depending therefrom to define a channel for receiving the another hinge arm segment.

22. The hinge of claim 21, wherein at least one more of the top hinge arm segment, the L-shaped hinge arm segment and base hinge arm segment further comprise opposing lateral edges and a pair of opposing side members depending therefrom to define a channel for inserting into the channel of another hinge arm segment.

23. The hinge of claim 13, wherein the base hinge arm segment further comprises a pair of back legs that rest against a back side of the furniture article frame and a pair of front legs that rest against a front side of the furniture article frame to ensure that the base hinge arm segment remains stable and in position once the door is attached to the hinge.

24. A hinge for mounting a door on a furniture article frame for movement between open and closed positions of the door relative to the furniture article frame, comprising:

a hinge cup member adapted to be affixed to the door;

a top hinge arm segment pivotably connected at its arm end to the hinge cup member and comprising an elongated aperture and two tabs;

an L-shaped hinge arm segment comprising a center hole, a circular aperture, an elongated aperture and two flaps;

an intermediate hinge arm segment comprising a circular aperture and two retaining ledges; and a first cam screw;

wherein the top hinge arm segment is pivotably connected to the hinge cup member on a first pivot axis, wherein the top hinge arm segment is slideably connected to the L-shaped hinge arm segment with the first cam screw;

wherein turning the first cam screw causes the top hinge arm segment to move relative to the L-shaped hinge arm segment in a horizontally side to side direction perpendicular to the first pivot axis of the hinge.

25. The hinge of claim 24, wherein the L-shaped hinge arm segment center hole comprises a mounting screw therethrough to secure the L-shaped hinge arm segment to the furniture article frame and wherein said center hole is elongated in a direction parallel to the first pivot axis of the hinge and is adapted to allow the L-shaped hinge arm segment to be displaced relative to the furniture article frame in a direction parallel to the first pivot axis of the hinge by loosening the mounting screw.

26. The hinge of claim 24, wherein the first cam screw is rotatable about a central axis thereof, wherein a projection extends from one end of the first cam screw parallel to the central axis thereof, and wherein the projection is radially offset from the central axis of the first cam screw.

27. The hinge of claim 24, wherein the top hinge arm segment is slideably connected to the L-shaped hinge arm segment by sliding the top hinge arm segment between the two retaining ledges on the intermediate hinge arm segment.

28. The hinge of claim 24 wherein, the intermediate hinge arm segment is fixedly-attached to the two retaining ramps of the L-shaped hinge arm segment via the two retaining ledges on the intermediate hinge arm segment, the L-shaped hinge arm segment and the intermediate hinge arm segments are adjustably connected to the top hinge arm segment with a first cam screw via the elongated aperture in the top hinge arm segment and the circular aperture in the L-shaped hinge arm segment and the circular aperture in the intermediate hinge arm segment.

29. The hinge of claim 24, wherein the intermediate hinge arm segment has a deflection of between 0 and 3 degrees.

30. The hinge of claim 29, wherein the intermediate hinge arm segment has a deflection of about 1.5 degrees.

* * * * *